US006532291B1

(12) United States Patent
McGrath

(10) Patent No.: US 6,532,291 B1
(45) **Date of Patent: *Mar. 11, 2003**

(54) HEAD TRACKING WITH LIMITED ANGLE OUTPUT

(75) Inventor: David Stanley McGrath, New South Wales (AU)

(73) Assignee: Lake DSP Pty Limited, Sydney (AU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/955,933

(22) Filed: Oct. 22, 1997

(30) Foreign Application Priority Data

Oct. 23, 1996 (AU) ..... PO 3160

(51) Int. Cl.[7] ..... H04R 5/00
(52) U.S. Cl. ..... 381/74; 381/310
(58) Field of Search ..... 381/74, 26, 309, 381/310, FOR 126

(56) References Cited

U.S. PATENT DOCUMENTS 3,962,543 A 6/1976 Blauert et al.
5,495,534 A * 2/1996 Inanaga et al. ..... 381/74
6,021,205 A * 2/2000 Yamada et al. ..... 381/74

* cited by examiner

*Primary Examiner*—Xu Mei
(74) *Attorney, Agent, or Firm*—Fulwider, Patton, Lee & Utecht, LLP

(57) ABSTRACT

A method is dislcosed for stabilizing the apparent location of an audio signal having spatial components, in the presence of movement of emission sources designed to emit the audio signal while maintaining the apparent location, the method comprising the steps of (a) high pass filtering a signal proportional to the angular position of the emission sources; (b) utilizing the high pass filtered signal as an apparent angular position of the emission sources to determine an apparent location of the audio signal. Preferably, the high pass filtered signal is limited utilizing a non-linear asymptotically bounded function to limit the signal.

5 Claims, 4 Drawing Sheets

HEAD TRACKING WITH LIMITED ANGLE OUTPUT

FIELD OF THE INVENTION

The present invention relates to the spatial localisation of sounds in a three dimensional space in the presence of movement of the sound source utilised to localise those sounds.

BACKGROUND OF THE INVENTION

It is known to localise sounds at a particular location in the presence of movement of sources. For example, U.S. application Ser. No. 08/723,614 entitled "Methods and Apparatus for Processing Spatialised Audio" describes a system for the localisation of a particular sound to a three dimensional location around a listener in the presence of movement of headphone speakers or the like.

Unfortunately, the necessary complexity of the systems described in the aforementioned application results in hem being unduly expensive. There is therefore a general need for an alternative form of sound localisation which maintains substantially all the benefits of the aforementioned system but is also substantially simplified.

SUMMARY OF THE INVENTION

It is an object of the present invention to provide for a simplified system which allows for the appearance of localisation of sounds through utilisation of the human auditory system.

In accordance with the first aspect of the present invention there is provided a method of determining an audio output of a substantially spatially localised audio signal, said method comprising accurately stabilising the apparent spatial location of said audio signal for small movements of at least one real sound source and relatively less accurately stabilising said apparent location for large movements of said sound sources.

In accordance with a further aspect of the present invention there is provided a method of stabilising the apparent location of an audio signal having spatial components, in the presence of movement of emission sources designed to emit the audio signal whilst maintaining said apparent location, said method comprising the steps of:

(a) high pass filtering a signal proportional to the angular position of said emission sources;

(b) utilising said high pass filtered signal as an apparent angular position of said emission sources to determine an apparent location of said audio signal.

Preferably, the high pass filtering includes limiting said high pass filter signal, preferably utilising a nonlinear asymptotically bounded function.

BRIEF DESCRIPTION OF THE DRAWINGS

Notwithstanding any other forms which may fall within the scope of the present invention, preferred forms of the invention will now be described, by way of example only, with reference to the accompanying drawings in which.

DESCRIPTION OF THE PREFERRED AND OTHER EMBODIMENTS

Figure 1:
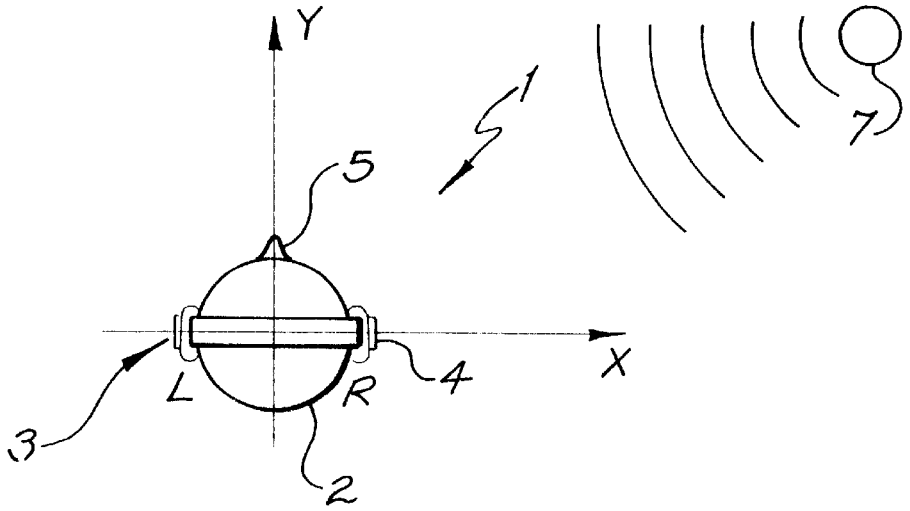
FIGS. 1 and 2 illustrate various coordinate reference frames for localisation of a sound listened to by the listener.

Referring now to FIG. 1, there is shown, in schematic form, a first arrangement 1 for measuring a coordinate system. In this coordinate system, a user's head 2 utilising left 3 and right 4 headphones is shown with the position of the user's nose indicated 5. Hence, a coordinate system having X and Y axis (in addition to Z axis not shown) can be provided and a suitable sound source 7 can be simulated by preprocessing of the output of the left and right headphone speakers. Methods for localising sound sources 7 to a particular spatial location are well known. Of course although the present discussion is with reference to a single sound source, it is well understood by those skilled in the art that the present invention can be readily applied to a sound "environment" comprising multiple sources, including reflections and other complex acoustic effects.

Figure 2:
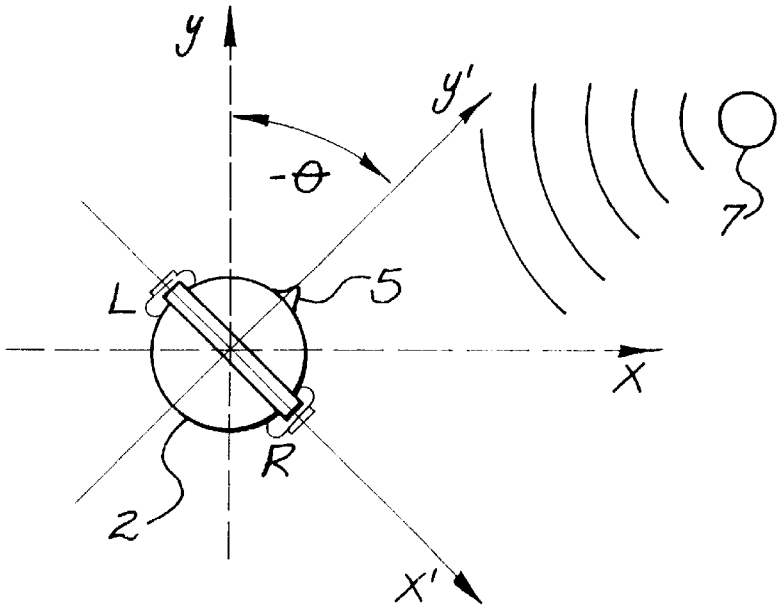

However, a problem exists when, as shown in FIG. 2, the user 5 turns his/her head to more accurately localised the sound source 7. In this respect, the user's coordinate frame has been altered in accordance with new coordinate axis X' and Y' which are at an angle θ with respect to the previous coordinates X and Y. Normally θ is measured in a counter clockwise sense, hence the θ of FIG. 2 will be a negative quantity. In the previously described systems, it is necessary to translate the sound source 7 to a new position in respect of coordinate axis X' and Y' so as to continue the illusion of the sound source coming from a particular location. Hence, the system processing the output for headphones 3, 4 must change the audio signal for each ear in response to rotation of the user's head.

Now, it is possible to define:

$$X_{L,\theta}(t)0 \leqq t < T \tag{1}$$

as the signal that would be played to the left channel 3 of the headsets for a sound source 7, given that the listener's head 2 is turned to angle θ, and:

$$X_{R,\theta}(t)0 \leqq t < T \tag{2}$$

as the signal that would be played to the right channel 4 of the headsets, given that the listener's head 2 is turned to azimuth angle θ. In this example, the signals are assumed to be of finite duration (T seconds).

Figure 3:
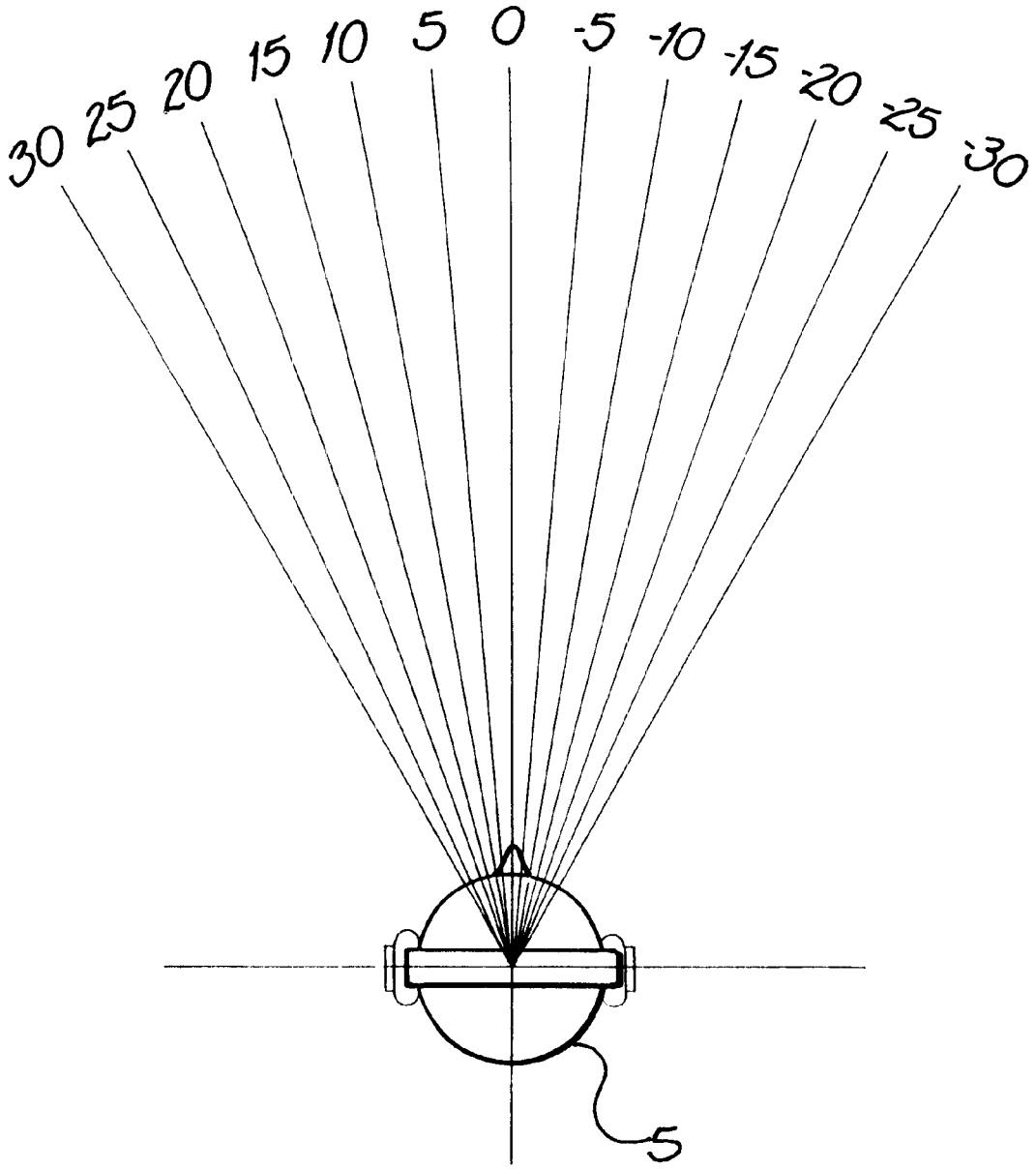
FIG. 3 illustrates the processing of localised sounds over a limited angle.

Referring now to FIG. 3, in a preferred embodiment, the signals $X_{R,\theta}$ and $X_{L,\theta}$ for a sound source might be only calculated 10 for a finite number of angles θ, for example, θ could be in multiples of 5° and range from −30° to 30°. For head positions between valid calculated angles, the actual $X_{R,\theta}$ and $X_{L,\theta}$ signals generate may be either interpolated between the two nearest valid angles or by simply rounding θ to the nearest valid angle. It is also expected that the user 5 will turn their head during normal operation of the system, so that, if the azimuth orientation angle of the user's head 5 at time t is θ(t) then the actual signal played to the left ear 3 will be:

$$X_L(t) = X_{L,\theta(t)}(t) \tag{3}$$

and the actual signal played to the right ear 4 will be:

$$X_R(t) = X_{R,\theta(t)}(t) \tag{4}$$

A head tracking audio system is often utilised to keep an apparent location of a sound source 7 fixed in an absolute location. This can help a user locate objects or events spatially around them while the user is free to turn their head to accurately locate the sounds. If the sound reaching the ears of the user does not change when the user's head turns, the resulting effect will be unnatural. In particular, it is particularly important that the audio system be capable of providing a convincing illusion of sounds projected from near the front of the user. This is because the human auditory system is particularly effective in making use of small phase and amplitude changes, that accompanying small head rotations, to more accurately determine the location of a particular sound source as well as discriminating between sounds in front and sounds from behind.

Figure 4:
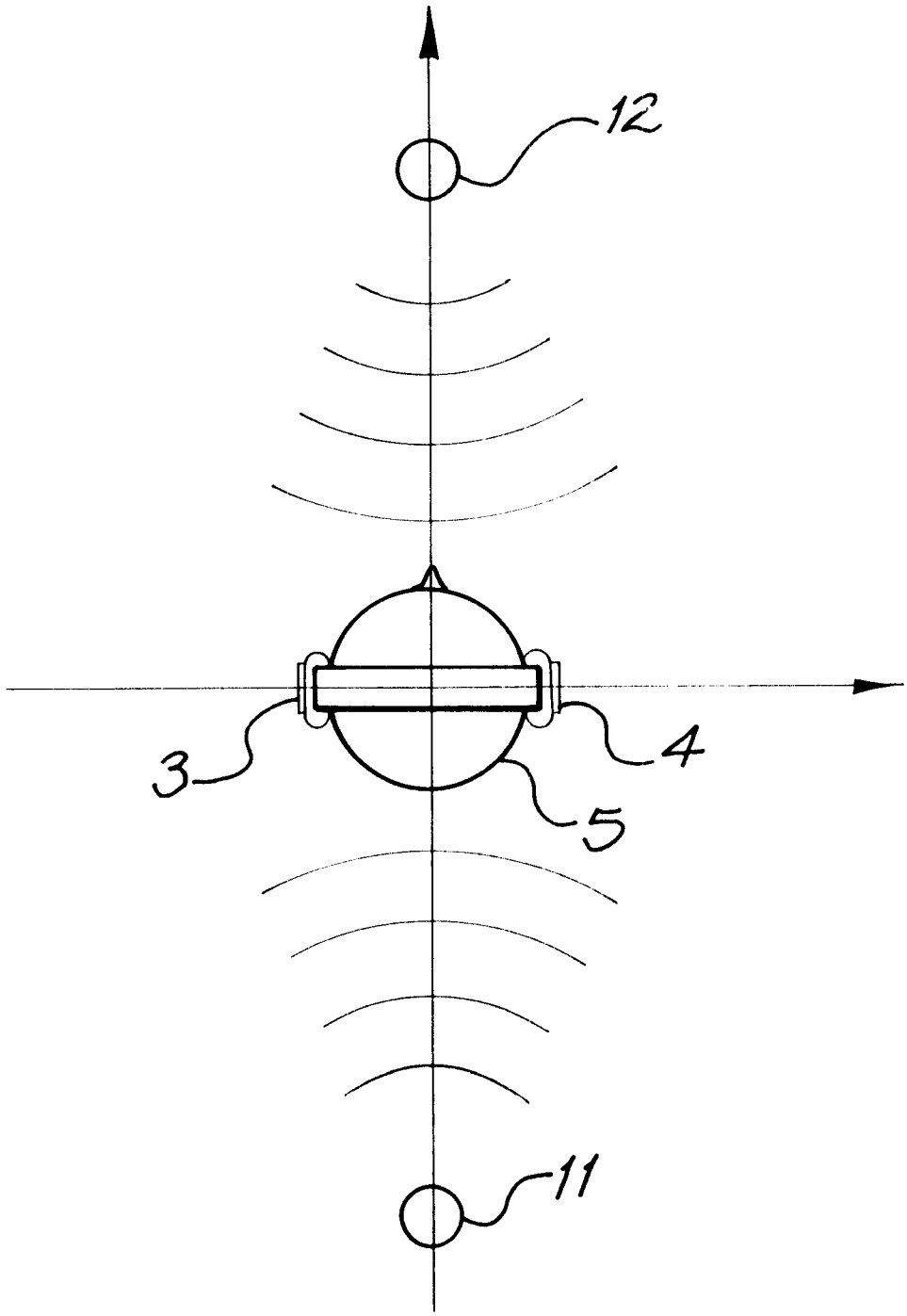
FIG. 4 illustrates the process of determining whether a sound originates from the front or behind a listener.

For example, referring now to FIG. 4, there is illustrated the situation where a listener 5 is presented with a stereo (binaural) signal over head phones 3, 4 wherein the signal is intended to give the illusion of a sound coming from directly in front 12. The listener's ears are assumed to be initially perpendicular to the axis containing a source. Hence, the sound will initially be presented with equal amplitude and delay to both ears of the listener. The listener most probably will wish to determine if the sound is coming from the front or the back, or even directly overhead, by turning their head a very small angle to the left (say) or right. In each of these three possible positions, all three of the sound locations will result in a signal that reaches both ears with equal magnitude and delay. However, upon turning the listener's head slightly, the sound coming from the front will now reach the right ear before the sound reaches the left ear, and the relative intensity of the sounds at each ear will also change. Hence, the right headphone speaker 4 should be processed to have an amplitude and delay different from the left headphone speaker 3. Of course, if the sound was arriving from behind, the opposite amplitude and delay shifts would result from the same head rotation. Further, the overhead sound would not change the signal to each ear. It is believed that the human auditory system is constructed or evolved to the point such that the response to small changes in the listener's head position is of great significance in allowing the accurate determination of the location of a sound image.

Hence, in the preferred embodiment, sound signals $X_{R,\theta}$ and $X_{L,\theta}$ are calculated to be valid over a small range of angles:

$$-\theta_m \leqq \theta \leqq \theta_m$$

Where θm might, for example be 30°. This calculation is done to take advantage of the highly accurate nature of the human auditory system over small angles.

Of course in such an embodiment it is necessary to have an effective scheme for the case where the user's head turns beyond the limited range of $\pm\theta_m$. Hence, in the preferred embodiment, small differential movements of the user's head are tracked accurately thereby maintaining accurate frontal images.

The case of large movement of the head is dealt with separately by either hard limiting the angle θ or by use of an asymptotically limited function as will become more apparent hereinafter.

One form of filtering for accurately maintaining the location of sound for small differential movements of the head operates as follows:

1. The user's head position is measured over time by a head tracking device to provide for a set of sample points: θ(n) $0 \leqq n < N$. This is a sampled signal.
2. This signal can then be high pass filtered to produce θ'(n) $0 \leqq n < N$, which has an average value of zero. One form of suitable high pass filtering is as follows:

$$\theta'(n) = \theta(n) - \theta_{LP}(n)$$

where:

$$\theta_{LP}(n) = \theta_{LP}(n-1) \times b + \theta(n) \times (1-b)$$

The value of b can be determined by the equation:

$$\tau \times F_{sample} = \frac{1}{1-b}$$

where τ is the time-constant of the filter (in seconds) and $F_{sample}$ is the sampling frequency of the headtracking process. A typical value of τ can be around 2 seconds. In this embodiment a simple first-order high pass filter is used, but other higher order functions may also be used.

3. The new, high pass filtered signal is then limited to the range $\pm\theta_m$ by either hard limiting, or through the use of a non-linear function. The result is θ"(n)<N. For example a suitable nonlinear function may be an inverse tangent function as follows:

$$\theta''(n) = \frac{2}{\pi} \times \theta_m x \tan^{-1}\left(\frac{\theta'(n)}{\theta_m} x \frac{\pi}{2}\right)$$

The new signal, θ"(n) will have a derivative that is very close to the derivative of θ(n) for small, rapid head movements. This means that the improvement in frontal images will be achieved via headtracking, even though the fixed location of sound sources is not maintained.

The signals that are played to the user are then as follows:

$$X_L(t) = X_{L,\theta''(t)}(t) \tag{5}$$

and:

$$X_R(t) = X_{R,\theta''(t)}(t) \tag{6}$$

In some cases, the head angle of the listener may be measured using a sensor (or sensors) that measure the rotational acceleration of the listener's head. Such systems can often suffer from drift, due to the lack of any method for determining an absolute angular velocity or displacement. In this case, it is also beneficial to apply extra filtering (effectively DC blocking) to remove offsets in the acceleration and velocity components of the angular displacement signal θ(n).

Figure 5:
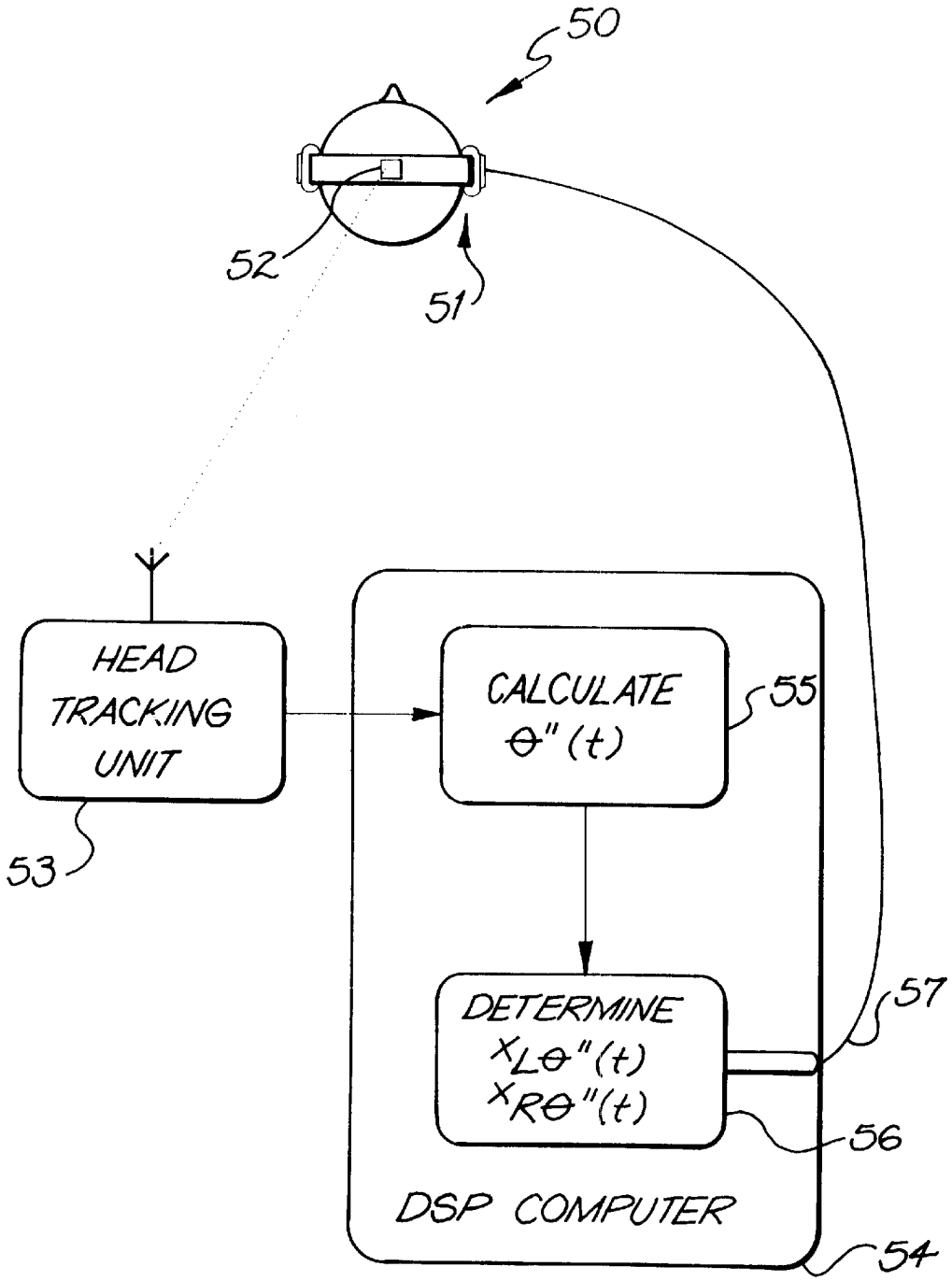
FIG. 5 illustrates an apparatus incorporating the preferred embodiment of the present invention.

Referring now to FIG. 5 there is illustrated one suitable embodiment of a sound listening system utilising the method described above. In this embodiment on a user's head 50 is placed a pair of headphones 51 having an integral tracking unit 52 which operates in conjunction with the head tracking unit 53 to determine a current angle θ at time t (θ(t)). A suitable head tracking unit system 52, 53 is the Polhemus 3-Space Insidetrack tracking system available from Polhemus, 1 Hercules Drive 560, Colchester, Vt. 05446, USA.

The output of the head tracking unit 53 is fed to a DSP computer 54 which can comprise the Motorola DSP 56002 EVM. The DSP computer is programmed to calculate θ"(t) in accordance with the above equations, and in real time. This is then utilised to determine signals for the left and right channel $X_{L,\theta''}(t)$ and $X_{R,\theta''}(t)$. These output signals can then be digital to analogue converted before being output as stereo outputs 57 for forwarding to the headphone speaker 51.

Of course, many other suitable arrangements are envisaged by the present invention.

It would be appreciated by a person skilled in the art that numerous variations and/or modifications may be made to the present invention as shown in the specific embodiment without departing from the spirit or scope of the invention as broadly described. The present embodiment is, therefore, to be considered in all respects to be illustrative and not restrictive.

I claim:

1. A method of determining an audio output of a substantially spatially localised audio signal, said method comprising the steps of:

(a) tracking the rotation of a listener's head by generating a head tracking signal; and (b) processing said audio signal for playback to said listener, such that said listener's head rotation is compensated for, to aid in the illusion that the resulting sound-field is fixed in space around said listener; wherein:

high pass filtering of said head tracking signal is utilized such that smaller head rotation movements of said listener that generate a head tracking signal of a sufficiently high frequency to be passed by said high pass filtering step, whilst failing to compensate for larger head rotation movements of said listener that generate a lower frequency, are measured.

2. A method as claimed in claim 1 wherein said step of tracking comprises utilizing a non-linear asymptotically bounded function to limit said head tracking signal.

3. An apparatus for listening to an apparent spatially localised sound wherein said sound has been processed in accordance with the methods of claim 1.

4. A method of stabilising an apparent location of an audio signal having spatial components, in the presence of movement of emission sources designed to emit said audio signal whilst maintaining said apparent location, said method comprising the steps of:

(a) high pass filtering a signal proportional to the angular position of said emission sources; and (b) processing said audio signal for presentation over said emission sources, said processing being adapted to provide an illusion of said spatial components being localised spatially around a listener, wherein locations of said spatial components relative to said listener are modified to maintain an impression of said spatial components being substantially stationary over a short-term time frame determined by said high pass filtering step, and wherein said high pass filtered signal is utilised to provide an apparent angular position of said emission sources in said processing of said audio signal.

5. A method as claimed in claim 4 wherein step (a) further comprises the step of limiting such high pass filtered signal.

* * * * *